United States Patent [19]

Falco

[11] Patent Number: 4,995,824

[45] Date of Patent: Feb. 26, 1991

[54] LINE COUPLING DEVICE

[75] Inventor: Robert N. Falco, Indianapolis, Ind.

[73] Assignee: Cabot Corporation, Waltham, Mass.

[21] Appl. No.: 425,623

[22] Filed: Oct. 23, 1989

[51] Int. Cl.[5] ..... H01R 13/28

[52] U.S. Cl. ..... 439/290; 439/286; 439/358

[58] Field of Search ..... 439/284, 286, 289, 290–293, 439/350, 358

[56] References Cited

U.S. PATENT DOCUMENTS

| | | | |
|---|---|---|---|
| 281,730 | 7/1883 | Ricketts | 439/287 |
| 3,414,865 | 12/1968 | Olsson | 439/290 |
| 4,820,182 | 4/1989 | Harwath et al. | 439/290 |

*Primary Examiner*—P. Austin Bradley

[57] ABSTRACT

There is disclosed herein a line coupling device whose coupling function is achieved by interleaving of plural elongate latching members bearing teeth thereon. The elongate latching members are supported in a member such that the coupling device may be readily coupled and uncoupled.

10 Claims, 1 Drawing Sheet

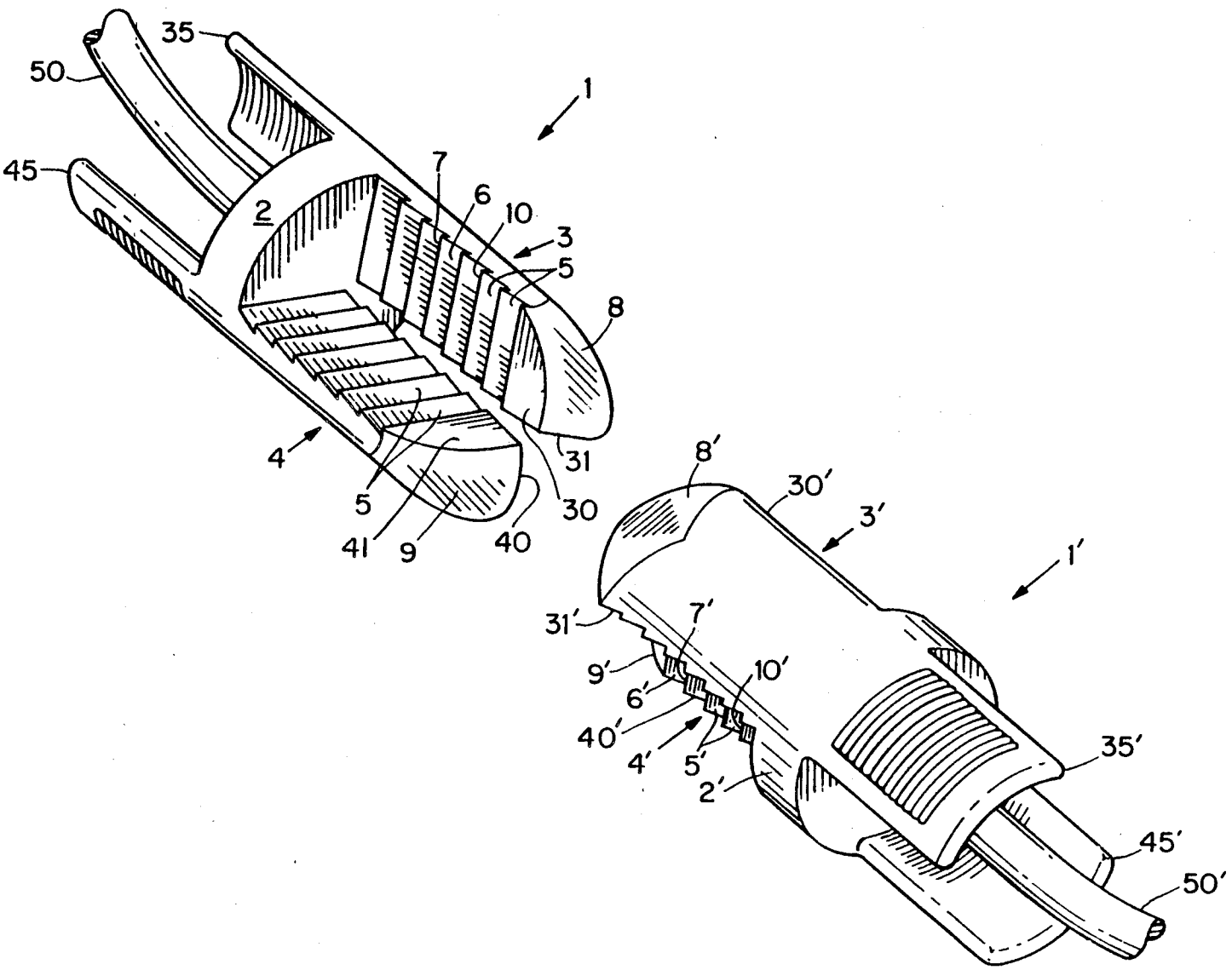
1
2
3
4
5
6
7
8
9
10
30
31
35
40
41
45
50
1'
2'
3'
4'
5'
6'
7'
8'
9'
10'
30'
31'
35'
40'
45'
50'

LINE COUPLING DEVICE

FIELD OF THE INVENTION

The present invention relates generally to a line coupling device of the type whereby lines may be detachably coupled together. While the invention is primarily concerned with means for physically coupling two lines together in a detachable manner, it may also be suitably conformed to provide additional functions, such as in the nature of an electrical connector.

OBJECTS OF THE INVENTION

It is a principal object of the invention to provide a novel line coupling device.

It is another object of the invention to provide a line coupling device having excellent security under tension loading thereof.

It is another object of the invention to provide a line coupling device wherein coupling and uncoupling thereof is readily achieved.

It is still another object of the invention to provide a line coupling device which is suited for fabrication by conventional thermoplastic injection molding techniques.

Other objects and advantages of the invention will, in part, be obvious and will, in part, appear hereinafter.

SUMMARY OF THE INVENTION

In accordance with the invention there is provided a line coupling device comprising a pair of interlatching body components. Each of said body components comprises a resilient rear wall element carrying thereon at least two elongate, forwardly extending, latching members of wedge-shaped cross section arranged equidistantly from and parallel to the longitudinal centerline of the body component. The convergent surfaces of each latching member of wedge-shaped cross section lie substantially on radii of the longitudinal centerline of the body component. The latching members of the construction are sized such that the latching members of the one body component interleave in at least a light interference fit relationship with the latching members of the other body component, thereby to place each convergent surface of each latching member of the one body component in facial contact along its length with the adjacent convergent surface of the latching member of the other body component interleaved therewith. The convergent surfaces of the latching members of the two body components are cooperatively toothed such that said teeth engage in latching relationship upon interleaving of the latching members of the one body component with the latching members of the other body component. The resilient rear wall element of each body component is of sufficiently stiff construction as to bias the latching members supported thereby into latching engagement with the latching members supported by the other body component, but is also sufficiently flexible as to allow sufficient flexure thereof to splay said latching members apart to the point of disengagement of the latching teeth thereof from those of the latching members of the other body component.

BRIEF DESCRIPTION OF THE DRAWING

The drawing hereof is a schematic, diagrammatic, perspective view of one embodiment of the coupling device of the invention shown in a disassembled state, the pair of body components thereof being shown in a suitable preliminary position for coupling of the one component to the other.

DESCRIPTION OF THE PREFERRED EMBODIMENTS

Referring now to the drawing, wherein like reference numerals refer to like structures, the coupling device of the invention comprises two body components 1 and 1'. Since the essential features of both body components are similar, for purposes of simplicity the following description will be directed to the one body component 1, it being recognized that similar features attend the other body component 1'. Accordingly, it will be appreciated that the specific structural features designated by the reference numerals associated with the one body component 1 are also called out in the drawing of the other body component 1' by means of the inclusion of a prime (') following the same reference numeral as is utilized for the corresponding element in the body component 1. With the foregoing in mind, therefore, the one body component 1 comprises a resilient rear wall element 2 which lies in a plane normal to the longitudinal centerline of said component 1. Supported from said rear wall element 2 are at least two forwardly extending elongate latching members 3, 4 of wedge-shaped cross section, which are arranged in equidistantly spaced and parallel relationship with respect to the longitudinal centerline of the one body component 1. Convergent surfaces 30, 40 and 31, 41 of said elongate latching members 3 and 4 lie substantially on radii of the longitudinal centerline of the body component 1. Where the body component 1 comprises two latching members 3, 4 as shown in the embodiment of the drawing and as is generally preferred, said latching members 3, 4 are in opposed relationship to one another and the convergent surfaces 30, 40 lie on one diametrical plane relative to the longitudinal centerline of the one body component 1 while the surfaces 31, 41 lie on another diametrical plane which is preferably displaced by about 90° from the plane defined by the surface 30, 40. Thus, where the body component 1 comprises two elongate latching members 3, 4, the angle defined between the convergent surfaces 30, 31 of latching member 3 and between the convergent surfaces 40, 41 of latching member 4 is preferably about 90°. As will be noted from the drawing, the latching members 3 and 4 are maintained as separate, discrete and spaced apart elements throughout their entire lengths, thereby establishing the resilient rear wall element 2 as the sole connecting member between said latching members 3 and 4. Moreover, the thickness and/or material of construction of the resilient rear wall element 2 is selected such that it may be flexed sufficiently as to cause disengagement of the latching members 3, 4 from the corresponding latching members 3', 4' of the other body component 1' of the construction. These are important design criteria in the construction of the present invention because, taken together, they contribute to sufficient flexibility in the overall construction as to enable unlatching of the interleaved latching members of the coupling device without destruction or harm being done thereto. Thus, one of the benefits of the present coupling device is that it may be repetitively coupled and uncoupled.

As has been mentioned before, while not essential to the attainment of many of the benefits of the invention, I prefer that no more than two opposed elongate latching members 3, 4 be utilized in the construction of the body component 1. Generally speaking, the provision of more than two elongate latching members per body component need not be contemplated unless the particular coupling device under consideration is quite large, for instance, a coupling device having a maximum cross sectional dimension of greater than about one inch (25.4 mm).

Each of the convergent surfaces 30, 31 and 40, 41 of the wedge-shaped elongate latching members 3, 4 is provided along the length thereof with a plurality of latching teeth 5, each tooth comprising a relatively shallow rearwardly directed ramp 6 whose rearmost margin 7 defines a sharp step 10 which preferably runs in a plane normal to the longitudinal axis of the body component 1. Thus, referring now to the one and the other body components 1 and 1', the convergent surfaces 30, 31 and 40, 41 of the one body component 1 and the corresponding surfaces 30', 31' and 40', 41' of the body component 1' together define a mutually cooperative multiple tooth latching system wherein the latching function of the coupling is served by engagement of the plural teeth 5 of each said surface of the latching members 3, 4 with the corresponding teeth 5' of the convergent surfaces of latching members 3', 4' of body element 1'. The number of teeth 5 or 5' provided in each of the convergent surfaces is subject to considerable variation and is generally not critical. I have found that when each of the convergent surfaces of the construction bears an array of from four to seven such latching teeth, there results a coupling construction in which excellent security of the assembled coupling obtains, particularly under tension loading thereof. Of course, other factors known to those of skill in the art also play a role in the coupling security of the device, such as the depth and angle of the steps 10, 10', the hardness and surface lubricity of the material of construction of the body components 1 and 1' and the closeness of the fit between the interleaved latching members 3, 4 and 3', 4' of the respective body components 1 and 1'.

Referring again solely to the body component 1, in another preferred embodiment of the invention the nose ends 8, 9 of the latching members 3, 4 are blunt or rounded off in order to facilitate assembly of the device.

In another preferred embodiment of the invention, the body components 1, 1' are each provided with two opposed elongate latching members 3, 4 and 3', 4' and at least the one body component 1 is further provided with spaced apart, opposed, finger tabs 35, 45, extending rearwardly from the resilient rear wall element 2. Tab 35 is coextensive with the latching member 3 and tab 45 is coextensive with the latching member 4. By virtue of the stiff, but flexible, construction of the rear wall element 2, the action of squeezing together of the opposed finger tabs 35, 45 causes the latching members 3, 4 to splay apart sufficiently as to disengage the plural latching teeth 5 of the coupling and to thereby facilitate decoupling of the device. In an even more preferred embodiment of the coupling device of the invention, body components 1 and 1' are provided with finger tabs as described above. In this last-mentioned embodiment, of course, it will be appreciated that the burden of splaying apart of the latching members 3, 4 and 3', 4' to the extent of disengagement of the latching teeth 5, 5' is shared between the body components 1 and 1'. Thus, providing body components 1 and 1' with finger tabs as described above even further facilitates decoupling of the device. Where finger tabs in accordance with the above description are not provided, decoupling of the coupling device of the invention can still be accomplished, albeit not as conveniently, by applying sufficient lateral forces to the resilient end wall elements 2, 2' of body components 1, 1', while using the longitudinal center of the latched coupling as a static fulcrum.

Completing the essential construction of the line coupling device of the present invention, any suitable means is provided by which to attach line means 50, 50' to the resilient rear wall elements 2, 2' of the one and the other body components 1, 1'. The term "line means" as employed herein, is intended to be interpreted broadly and includes such specific examples as a line, belting, bead chain, thread, yarn, cord, cable, wire and tether. Accordingly, the specific means by which to attach such a diversity of contemplated line means to the rear wall elements 2, 2' is subject to substantial and non-critical variation with respect to the invention and is within the skill of those in the art. For instance, said attachment means can take the simple form of a self-tapping screw screwed into each of the resilient rear wall elements 2, 2'. Alternatively, the attachment means can also take the form of glue dabs. Where the coupling device of the invention is fabricated by injection molding of a thermoplastic polymer material, as outlined below, the attachment of the line means 50, 50' can often be achieved simply by molding the ends thereof into the rear wall elements 10 2, 2' of the coupling device. Thus, many specific attachment means suitable for use in the present invention will suggest themselves to those of skill in the art.

The coupling device of the invention is particularly amenable to fabrication of its components by injection molding of thermoplastic materials of construction. Suitable polymeric materials for use as materials of construction for the coupling device of the invention will be apparent to those of skill in the art. For instance, alpha-olefin polymers, such as polyethylene, polypropylene and polystyrene; polyamides such as nylon; thermoplastic polyurethanes; acrylic polymers such as polymethylmethacrylate; polyacetals; polycarbonates; thermoplastic copolymers such as copolymers of acrylonitrile-butadiene-styrene, vinyl chloride-vinyl acetate, ethylene-vinyl acetate, ethylene-propylene and the like are generally suitable. I have found, for instance, that a coupling device of the invention suitable for many applications can be readily and economically thermoformed by injection molding of a linear polyethylene material. If desired, of course, many thermoplastic polymer candidates for the construction of the line coupling device of the invention can also be cured or crosslinked into a tough infusible state, such as by radiation or chemical curing thereof, once molding has been achieved.

Obviously, many changes, modifications and alterations may be accomplished relative to the above description of the device of the invention without departing from the essential scope and spirit thereof. For instance, where the line means 50, 50' comprise electrically conductive wires, the line coupling device of the invention can be readily modified to the form of an electrical connector by providing suitable male and female connector elements through the wall elements 2, 2' of the one and the other body components 1, 1'and by placing the wire line means 50, 50' into electrical communication, such as by soldering thereof, with said connector elements.

Accordingly, while there are above described a number of specific embodiments of the present invention, it is obviously possible to produce other embodiments and various equivalent modifications thereof without departing from the spirit of the invention.

Having set forth the general nature and several preferred embodiments of the present invention, the true scope thereof is now particularly pointed out in the appended claims.

What is claimed is:

1. A line coupling device comprising two body components, each said body component comprising:

A. a resilient rear wall element;

B. at least two forwardly extending latching members supported by said rear wall element, said members being arranged parallel to and equidistantly spaced along their lengths from the longitudinal centerline of said body component, each of said members having a nose end, (i) each of said members being of wedge-shaped cross section and defining a pair of convergent surfaces lying on radii of said longitudinal centerline, and (ii) each said convergent surface having a plurality of latching teeth along the length thereof, the latching members of the one body component being interleavable with respect to the latching members of the other body component with the convergent surfaces of the latching members of the one body component being in at least light interference fit with respect to the corresponding adjacent convergent surfaces of the latching members of the other body component in the interleaved condition, thereby to engage the plural latching teeth of each of said convergent surfaces of the latching members of the one body component in cooperative latching engagement with the plural latching teeth of the corresponding convergent surfaces of the other body component; and C. means for attaching line means to each said resilient rear wall element.

2. The line coupling device of claim 1 wherein each said latching tooth is defined by a relatively shallow, rearwardly directed ramp having a rear margin which defines a step oriented in a plane normal to the longitudinal centerline of the body component.

3. The line coupling device of claim 1 wherein the nose end of each said elongate latching member is rounded.

4. The line coupling device of claim 1 fabricated by injection molding of a thermoplastic polymeric material of construction.

5. The line coupling device of claim 1 wherein each said body component comprises two opposed elongate latching members.

6. The line coupling device of claim, 5 wherein the angle subtended between the convergent surfaces of each of the two opposed elongate latching members is about 90°.

7. The line coupling device of claim 5 wherein at least one of said body components comprises a pair of finger tabs supported by said resilient wall element, one of said tabs being coextensive with one of said two opposed elongate latching members and the other of said tabs being coextensive with the other of said two opposed elongate latching members, said finger tabs being spaced apart and extending rearwardly of said resilient rear wall element.

8. The line coupling device of claim 5 wherein each of the body components comprises a pair of finger tabs supported by said resilient wall element, one of said tabs being coextensive with one of said two opposed elongate latching members and the other of said tabs being coextensive with the other of said two opposed elongate latching members, said finger tabs being spaced apart and extending rearwardly of said resilient rear wall element.

9. The line coupling device of claim 1 composed of a thermoplastic polymer.

10. The line coupling device of claim 9 composed of linear polyethylene.

* * * * *